US005900108A

United States Patent [19]

Sekine

[11] Patent Number: 5,900,108

[45] Date of Patent: May 4, 1999

[54] HANDY LABELER

[75] Inventor: Kiyoyuki Sekine, Ageo, Japan

[73] Assignee: Shinsei Industries Co., Ltd., Tokyo, Japan

[21] Appl. No.: 09/043,138

[22] PCT Filed: Jul. 4, 1997

[86] PCT No.: PCT/JP97/02328

§ 371 Date: Mar. 9, 1998

§ 102(e) Date: Mar. 9, 1998

[87] PCT Pub. No.: WO98/01345

PCT Pub. Date: Jan. 15, 1998

[30] Foreign Application Priority Data

Jul. 10, 1996 [JP] Japan ..... 8-180807

[51] Int. Cl.[6] ..... B65C 11/02

[52] U.S. Cl. ..... 156/384; 156/540; 156/541; 156/577; 156/579

[58] Field of Search ..... 156/384, 387, 156/540, 541, 542, 577, 579

[56] References Cited

U.S. PATENT DOCUMENTS

| | | | |
|---|---|---|---|
| 4,057,452 | 11/1977 | Sato | 156/384 |
| 5,045,145 | 9/1991 | Becker | 156/384 |
| 5,254,206 | 10/1993 | Wing | 156/542 |
| 5,258,090 | 11/1993 | Becker et al. | 156/384 |
| 5,486,259 | 1/1996 | Goodwin et al. | 156/384 |
| 5,525,184 | 6/1996 | Luff et al. | 156/361 |

FOREIGN PATENT DOCUMENTS

| | | |
|---|---|---|
| 54-137300 | 10/1979 | Japan . |
| 55-500297 | 5/1980 | Japan . |
| 59-9420 | 3/1984 | Japan . |
| 6-171636 | 6/1994 | Japan . |

*Primary Examiner*—James Sells
*Attorney, Agent, or Firm*—Fish & Richardson P.C.

[57] ABSTRACT

An arm (10c) of a manual lever (10) is formed with a pushing portion (**10*f*). A ratchet pawl (17) making reciprocal movement in synchronization with the manual lever (10) is formed with a resilient portion (17*a*) to be pushed by the pushing portion (10*f*) and a pawl portion (17*b*) which makes contact with a tooth of the ratchet wheel (19). A printer (P) is disposed at tip ends of the arms (10*c*, 10*d*). The ratchet wheel (19) is integral with the transfer drum (18). In the step of gripping the manual lever (10), the resilient portion (17*a*) is made to deform, and the pawl portion (27*b*) makes slide movement toward a tip end of a tooth. At the moment when the pawl portion (17*b*) gets over the tip end of a tooth, a resistive force against the manual lever (10) is significantly reduced, and as a result, the printer (P) makes impact contact with a label and prints marks on the label. When the label tape (12) is to set, the bottom cover (14) is made open. The bottom cover (14) can be surely open due to a biasing force accumulated in resilient portions (15*d*, 15*e*) by pressing a finger-placed portion (15*a*) of an engagement member (15**).

1 Claim, 10 Drawing Sheets

HANDY LABELER

TECHNICAL FIELD

The invention relates to a handy labeler including a plurality of labels temporarily adhered onto a tape-like mount sheet, marks about price and date and so on being printed on the labels, and the labels being peeled off the mount sheet to adhere the label onto an article or a package thereof each time the label is printed.

BACKGROUND ART

A handy labeler is required to be smaller in size and lighter in weight than conventional ones, because it is gripped when used. However, a handy labeler has been widely used in retail stores as well as big grocery stores, it is now further required to fabricate at lower costs. In addition, as a handy labeler has been widely used, it is used in a variety of ways. Specifically, it is often used roughly, and those who are not used to handling a handy labeler use it. Hence, a handy labeler is required to be tough, and to be able to print at a certain printing concentration, even if it is used in whatever ways. To this end, there have been suggested a lot of pressure adjusting systems for printing at a certain printing concentration without being influenced by a speed of gripping of an operator. One of them is suggested in Japanese Unexamined Patent Publication No. 6171636.

However, the pressure adjusting system suggested in the Publication includes a manual lever an operator grips, an arm (manual arm), a separate part from the manual lever, for handling a printer, and a spring (impact spring) or an intermediate member disposed between them. Namely, the system is quite complicated in structure. In addition, it is necessary to make the manual lever and the arm move in synchronization with each other, and to set various conditions for forces of springs acting on the arm. It is difficult to fabricate a handy labeler so that it can withstand harsh use. Above all, the pressure adjusting system in question has a problem that it is high at costs to fabricate.

Thus, it is an object of the present invention to provide a handy labeler which is capable of providing a printing concentration sufficiently stable for practical use without problems, and has a quite simple structure.

DISCLOSURE OF THE INVENTION

The present invention provides a handy labeler including a label tape comprising a long mount sheet and a plurality of labels temporarily adhered onto the mount sheet, a printer being made to make contact with the labels from a stationary position and print on the labels in a manual lever gripping step, the printer being made to return to the stationary position and a transfer drum being made to rotate to thereby feed the label tape by one label distance in a manual lever releasing step, a printed label being peeled off the mount sheet and partially fed outside a main body, the handy labeler being characterized by: a ratchet pawl having a pawl portion and a resilient portion deformable by being compressed by the manual lever, the ratchet pawl making forward movement in a manual lever gripping step and making backward movement in a manual lever releasing step; and a ratchet wheel having a plurality of ratchet teeth including longer tooth surfaces and shorter tooth surfaces, the pawl portion making slide movement on the longer tooth surfaces towards a distal end of the tooth, when the ratchet pawl makes forward movement, the ratchet wheel being rotated by the shorter tooth surfaces being compressed by the pawl portion to thereby rotate the transfer drum, when the ratchet pawl makes backward movement, the resilient portion being deformed by the manual lever when the pawl portion is making slide movement on the longer tooth surfaces while the ratchet pawl makes forward movement, and resulting resilient force acting on the manual lever as a resistive force, the resistive force being abruptly decreased at the moment when the pawl portion exceeds the distal end of tooth to thereby cause the manual lever to make the printer make impact contact with the label. The invention makes it possible to provide constant printing concentration regardless of a speed of gripping a manual lever, which ensures that a handy labeler can be fabricated at lower costs, at a lighter weight, and more rigid.

BEST MODE FOR CARRYING OUT THE INVENTION

Figure 1:
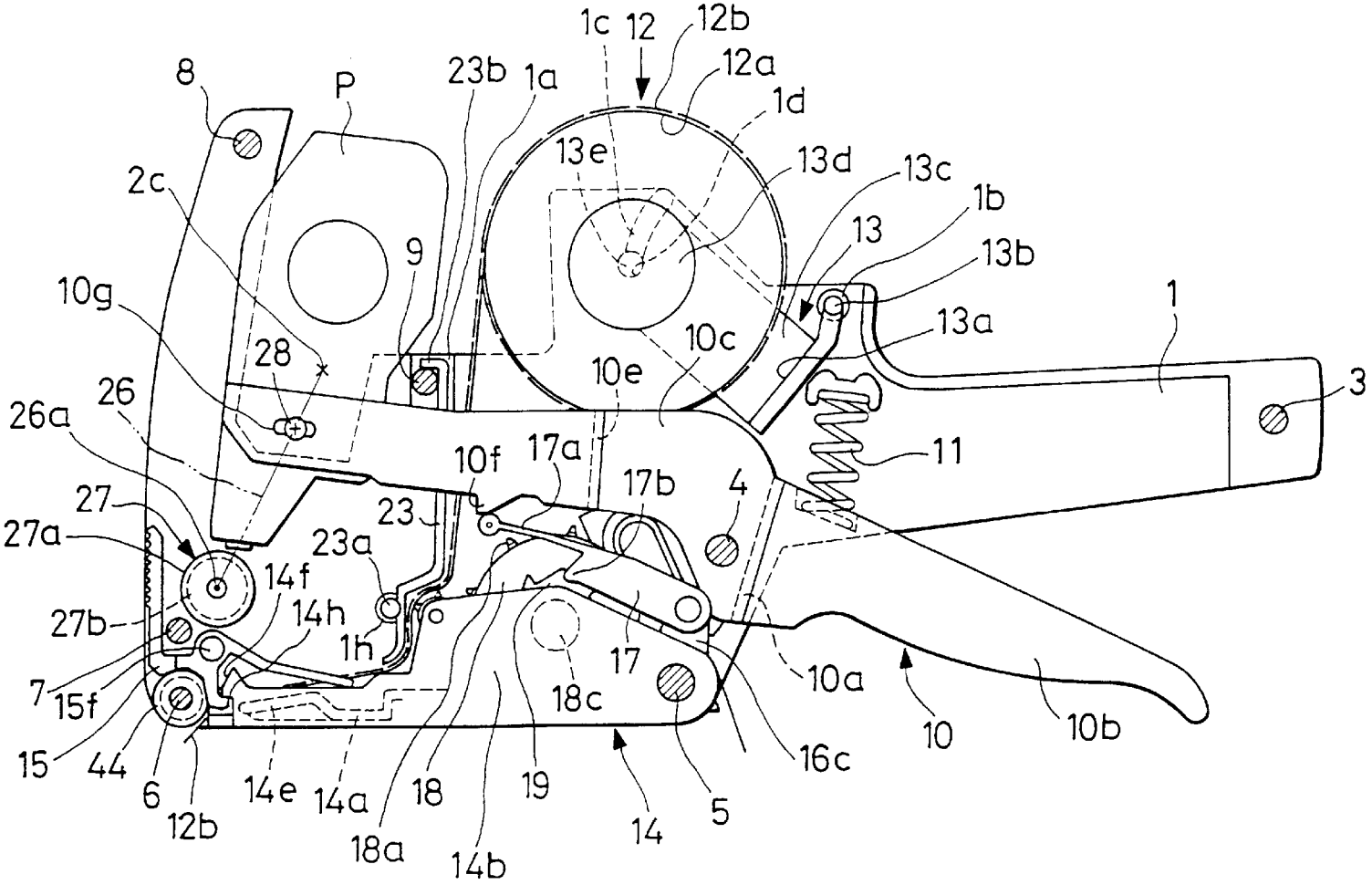
FIG. 1 is a side view of a handy labeler in accordance with the present invention with one of outer walls being removed.

First, hereinbelow is explained a structure of the instant embodiment. As mentioned earlier, FIG. 1 is a view of a handy labeler with one of two outer walls being removed, which outer walls constitute a housing as a main body of a handy labeler. Thus, FIG. 1 illustrates only the other outer wall 1. FIGS. 4B, 5B, 6B and 7B are views illustrating a handy labeler viewed from a rear of FIG. 1 with the outer wall 1 being removed, and thus illustrate a part of the other wall 2. These outer walls 1 and 2 are made of synthetic resin, and are symmetric in shape. They form a certain space therebetween, and secured to each other by shafts 3, 4, 5, 6, 7, 8 and 9.

A manual lever 10 is supported by the shaft 4 for rotation about the shaft 4. The manual lever 10 is comprised of a grip portion 10*b* and two arms 10*c* and 10*d* (arm 10*d* is illustrated in FIGS. 4B, 5B, 6B and 7B), which grip portion 10*b* and the arms 10*c* and 10*d* are partitioned by a branch portion 10*a,* and has a fork-like shape. A compression spring 11 is disposed between the outer walls 1, 2 and the grip portion 10*b*. When the housing and the grip portion 10*b* are gripped, the grip portion 10*b* accordingly rotates in a counterclockwise direction, resulting in that the compression sprint 11 is compressed. When the housing and the grip portion are released from being gripped, the grip portion 10*b* rotates in a clockwise direction because of spring force of the compression spring 11. The rotation of the grip portion 10*b* stops when the arms 10*c* and 10*d* make abutment with stoppers 1*a* and 2*a* (stopper 2*a* is seen in FIGS. 4B, 5B, 6B and 7B) formed as a thicker wall portion on the outer walls 1 and 2, respectively. The arm 10*c* is formed with a folded portion 10*e,* a pushing portion 10*f* and a slot 10*g,* whereas the arm 10*d* is formed with a tooth portion 10*h,* a slot 10*i* and a pin 10*j,* as illustrated in FIGS. 4B, 5B, 6B and 7B.

As well known, the label tape 12 before used is comprised of the long mount sheet 12*a* and a plurality of the tapes 12*b* temporarily adhered on the mount sheet, and is wound in a roll. Hereinbelow, there is explained a structure for supporting a roll of the label tape 12 for rotation. A tape supporting member 13 is made of synthetic resin, and includes a guide portion 13*a* situated between the outer walls 1 and 2, a shaft portion 13*b* projecting towards the outer walls 1 and 2, a plate-shaped support portion 13*c* extending along the outer wall 1 from the guide portion 13*a,* a body portion 13*d* formed at a distal end of the support portion 13*c,* and a spherical projecting portion 13*e* projecting towards the outer wall 1 from a center of the body portion 13*d*. One of ends of the tape support member 13 is rotatably fit into a cylindrical bearing 1*b* formed on the outer wall 1, and the other end is rotatably fit into a cylindrical bearing (not illustrated) formed on the outer wall 2. The outer wall 1 is formed with an arcuate groove 1*c* and a groove 1*d* which is in continuation with the groove 1*c* at an end of the groove 1*c* and has a greater diameter than a width of the groove 1*c*. The body portion 13*d* is formed closer to you than the support portion 13*c*. The projecting portion 13*e* includes a surface facing the outer wall 1 of the support portion 13*c* at the center of the body portion 13*d,* and a surface facing the outer wall 2 of the body portion 13*d*. The outer wall 2 is formed with the same grooves as the grooves 1*c* and 1*d* in mirror-symmetry fashion.

When a new label tape 12 is set, the projecting portion 13*e* engaged in the groove 1*d* (2*d*) is moved into the groove 1*c* (2*c*) to thereby rotate the tape support member 13 in a clockwise direction, receiving a resistance from the groove 1*c* (2*c*). Then, after the tape support member 13 has been sufficiently rotated, a new roll of the label tape 12 is set around the body portion 13*d*. Then, the tape support member 13 is pushed in a counterclockwise direction, and the projecting portion 13*e* is made to make slide movement, receiving a resistance from the groove 1*c*. Finally, the projecting portion 13*e* is fit into the groove 1*d* (2*d*) having a greater diameter. Thus, the new label tape is set, as illustrated in FIG. 1.

Then, a structure for opening and closing the bottom cover 14 is explained hereinbelow. As will be understood in view of FIGS. 1 and 2, the bottom cover 14 is comprised of a bottom 14*a* and oppositely facing sidewalls 14*b,* 14*c* all of which are integrally made of synthetic resin. A guide portion 14*d* is also integrally formed between the sidewalls 14*b* and 14*c*. The bottom 14*a* is formed with a support plate 14*e,* and the sidewalls 14*b* and 14*c* are formed with inclined surface portions 14*f* and 14*g,* respectively. An engagement portion 14*h* is formed in the vicinity of the inclined surface portion 14*f*. Though not illustrated, an engagement portion 14*h* similar to the engagement portion 14*h* is formed in the vicinity of the inclined surface portion 14*g* in symmetry. As will be understood in view of FIGS. 4A and 4B, the sidewalls 14*b* and 14*c* are formed at their distal ends with guide portions 14*i* and 14*j* projecting towards each other. The bottom cover 14 having the above mentioned structure is rotatably carried at the shaft 5 by the sidewalls 14*b* and 14*c*.

Figure 2:
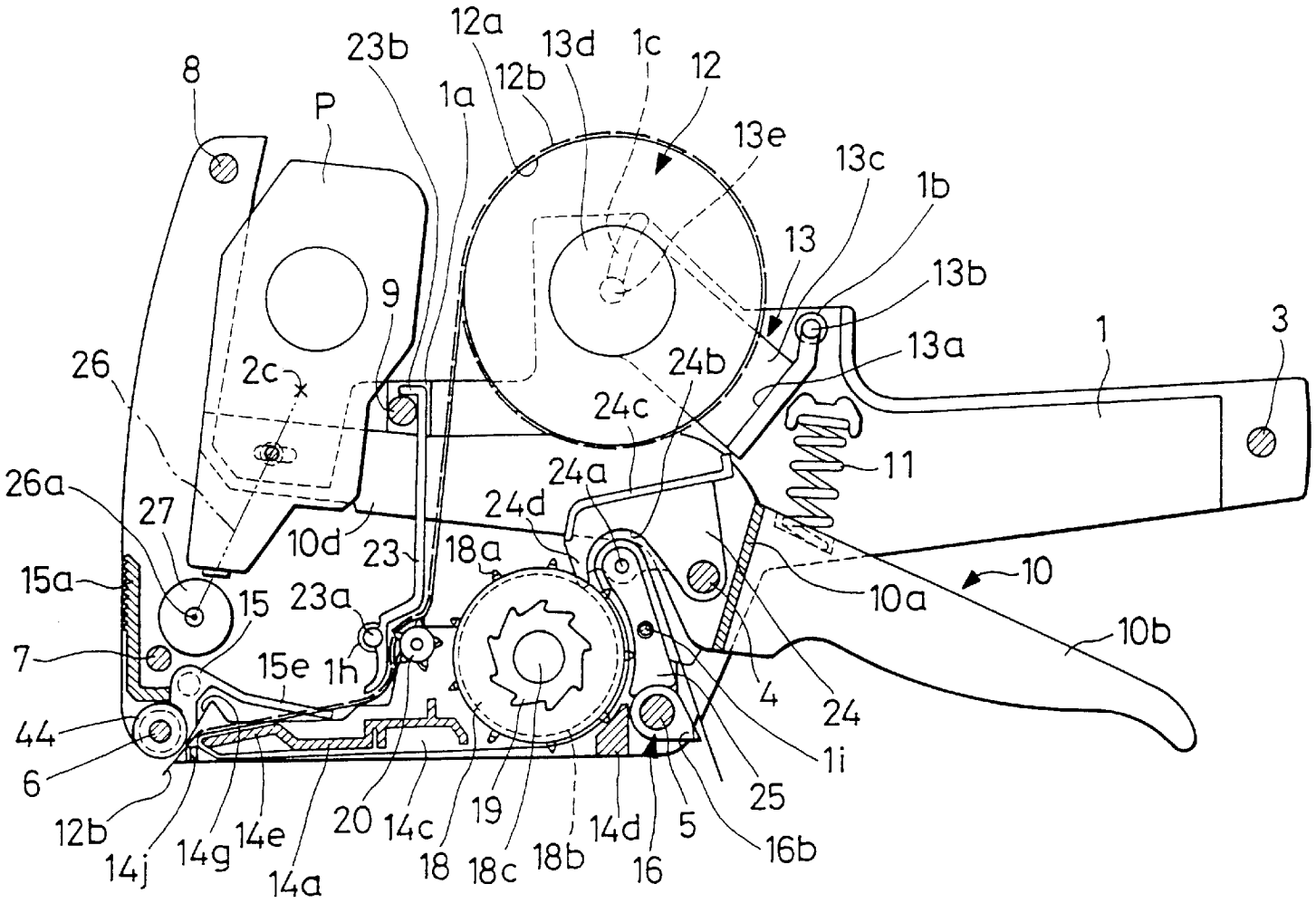
FIG. 2 is a side view, similar to FIG. 1, with some parts being removed in FIG. 1.
Figure 3:
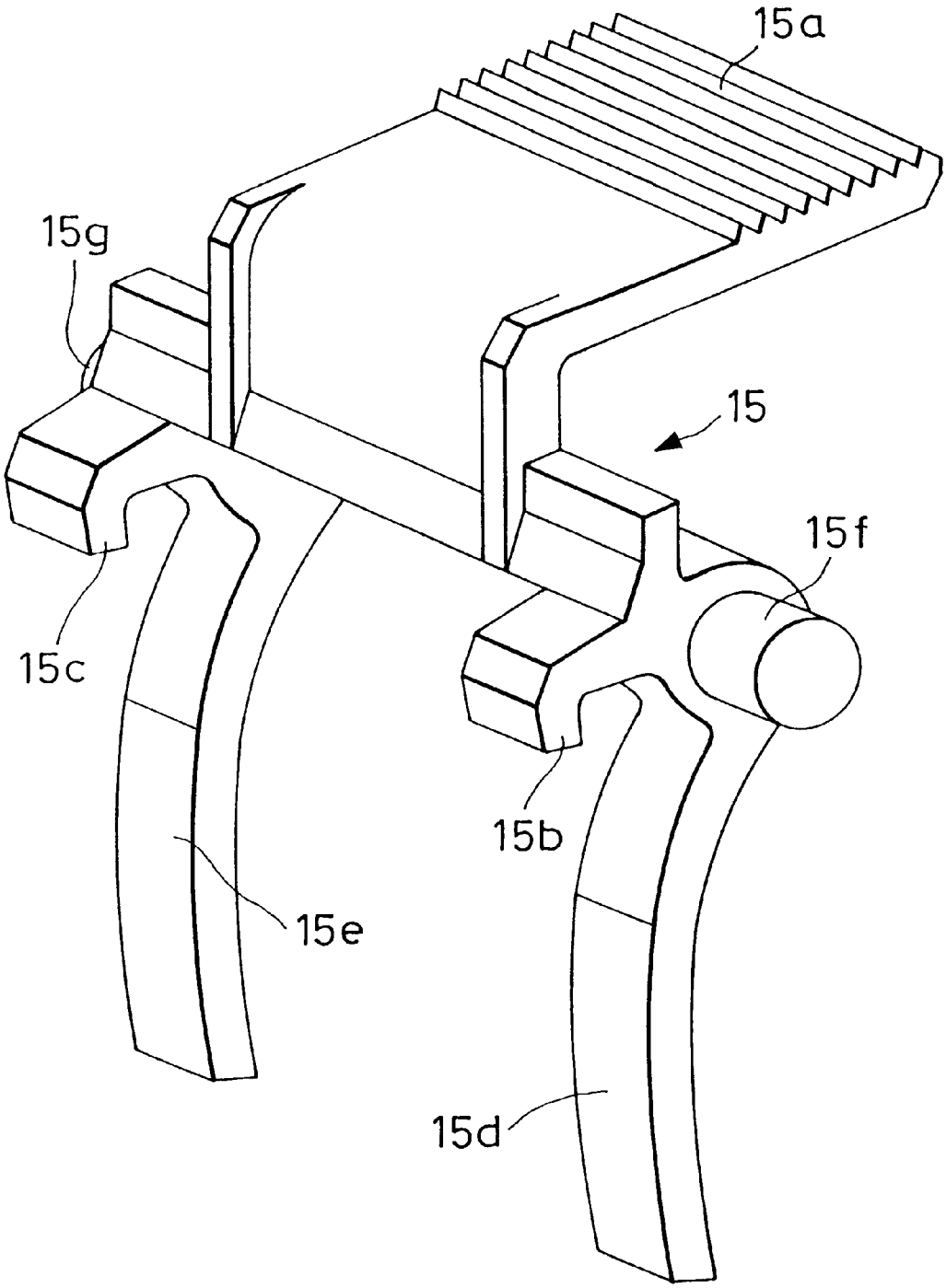
FIG. 3 is a perspective view of an engagement member of a bottom cover illustrated in FIG. 1.
Figure 8:
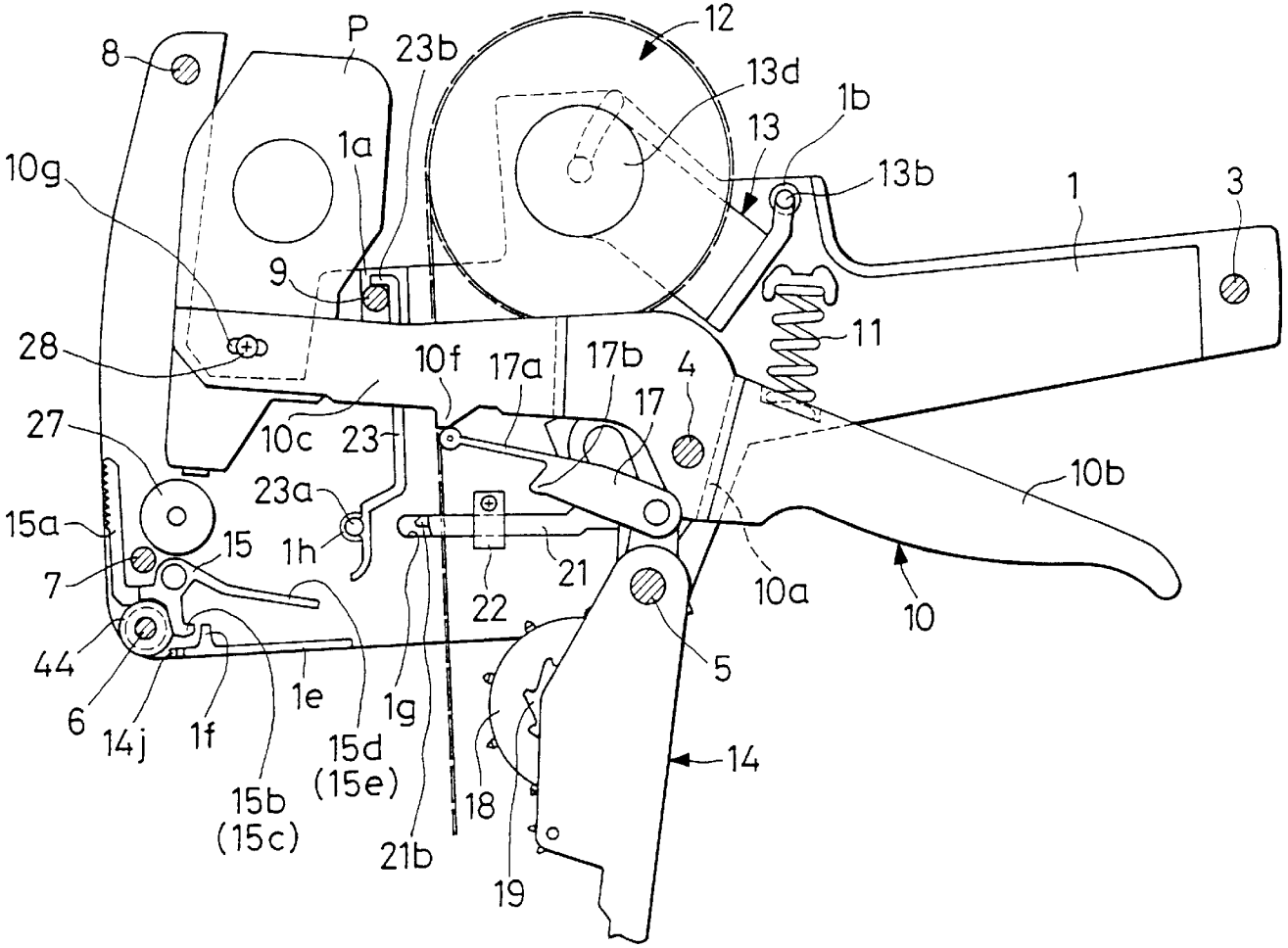
FIG. 8 is a side view, similar to FIG. 1, with a bottom cover open.

With reference to FIG. 3 as well as FIGS. 1 and 2, an engagement member 15 of the bottom cover 14 is explained hereinbelow. In FIG. 2, a part of the engagement member 15 is illustrated with a broken line. The engagement member 15 is made of synthetic resin, and has a finger-placed portion 15*a* at the center, and hook portions 15*b* and 15*c,* resilient portions 15*d* and 15*e,* and shaft portions 15*f* and 15*g* in symmetry at the opposite sides of the finger-placed portion 15*a*. The shaft portions 15*f* and 15*g* are rotatably fit into bearing holes (not illustrated) formed at the outer walls 1 and 2. As illustrated in FIG. 8, the outer wall 1 is formed with stoppers 1*e* and 1*f* extending towards the outer wall 2. The rotation of the engagement member 15 in a clockwise direction is ceased when the resilient portion 15*e* abuts the stopper 1*e,* and the rotation of the engagement member 15 in a counterclockwise direction is ceased when the hook portion 15*c* abuts the stopper 1f. Though not illustrated, the outer wall 2 is formed with the same stoppers as the stoppers 1*e* and 1*f* in symmetry with the stoppers 1*e* and 1*f*, projecting towards the outer wall 1. The resilient portion 15*d* and the hook portion 15*b* of the engagement member 15 are designed to make abutment with the stoppers.

Hereinbelow is explained a structure for feeding the label tape 12. As will be understood in view of FIGS. 4A to 7B, a transfer member 16 is rotatably supported at its cylindrical portion by the shaft 5. The transfer member 16 is made of synthetic resin, and is formed with a partial gear 16*a* closer to the outer wall 1 than the outer wall 2, which gear is in mesh with a tooth portion 10*h* formed at the arm 10*d*. A cutter portion 16*b* projects from the cylindrical portion out of a housing. The outer wall 2 is formed with an expanded portion 16*c*. A ratchet pawl 17 is rotatably carried by a shaft portion 16*d* formed at a distal end of the expanded portion 16*c*. The ratchet pawl 17 is formed with a flexible resilient portion 17*a* and a pawl portion 17*b*. The resilient portion 17*a* has an distal end which make slide contact with the pushing portion 10*f* of the manual lever 10. The transfer drum 18 is made of synthetic resin, and is formed at an outer surface thereof with a plurality of pins 18*a* at an equal pitch. As is well known, the pins 18*a* fit into perforations (which is also referred to as feeding cuts. Perforations are comprised of round holes or slits. In the instant embodiment, perforations are comprised of round holes.) formed at the label tapes 12.

The transfer drum 18 is formed at an outer surface thereof with two ring-shaped grooves at opposite sides of the pins 18*a*. One of the grooves 18*b* is illustrated in FIG. 2 with a broken line. The transfer drum 18 is integrally, coaxially formed with a ratchet wheel 19 at a side surface facing the outer wall 2. As is well known, the ratchet wheel 19 is formed with a plurality of teeth each having a longer tooth surface and a shorter tooth surface. The pawl portion 17*b* makes contact with these tooth surfaces. The transfer drum 18 is formed at side surfaces thereof with shaft portions 18*c* and 18*d,* which are rotatably fit into bearing holes (not illustrated) formed at the sidewalls 14*b* and 14*c* of the bottom cover 14.

Figure 4A:
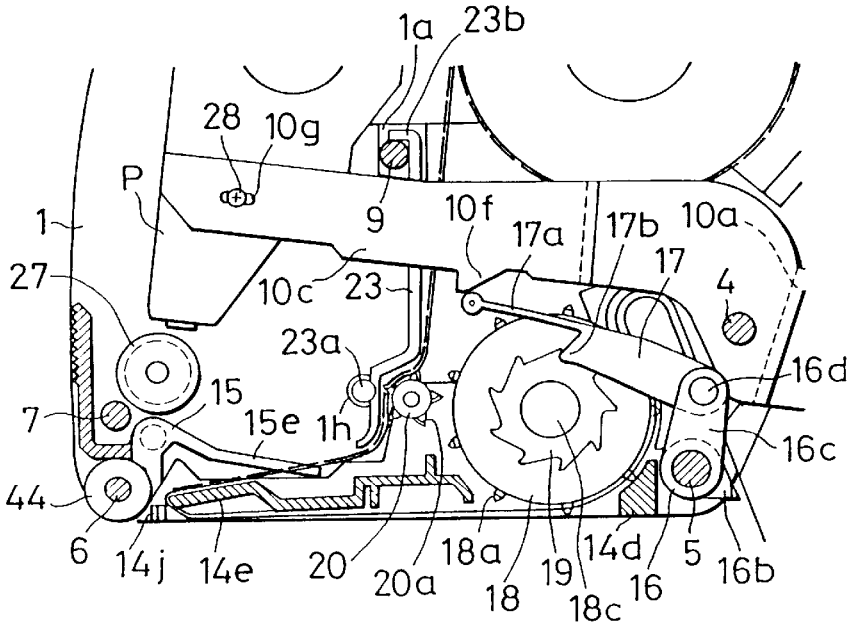
FIG. 4A is an enlarged view of a gist of FIG. 1.
Figure 4B:
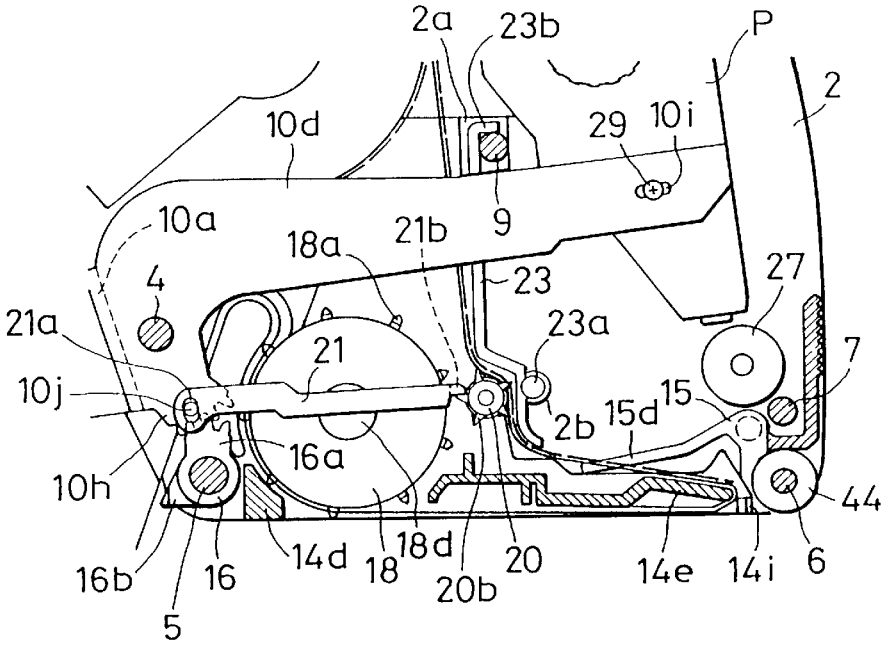
FIG. 4B is a rear view of FIG. 4A with an outer wall being removed.

A label stopper 20 is rotatably supported on the sidewalls 14*b* and 14*c* of the bottom cover 14. The label stopper 20 is a shaft member as a whole, and is formed centrally with five hooks 20*a* which are similar to the pins 18*a* of the transfer drum 18 and are fit into holes (not illustrated) formed at the label tape 12. The label stopper 20 is formed at an end closer to the sidewall 14*c* outside a path of the label tape 12 with five stopper pawls 20*b.* As illustrated in FIG. 8, the outer wall 1 is formed with a groove 1*g* horizontally extending, in which a slide member 21 is to be positioned. In order to prevent the slide member 21 from disengaging from the groove 1*g,* the outer wall 1 is formed with a retainer 22. As illustrated in FIG. 4B, the slide member 21 is formed with a long hole 21*a* and an engagement portion 21*b* directing towards the label stopper 20. The pin 10*j* of the arm 10*d* is fit into the long hole 21*a,* and the engagement portion 21*b* is designed to make engagement with the five stopper pawls 20*b.*

A guide portion is quite important for the structure for feeding the label tape 12. The guide portion 13*a* formed at the tape support member 13 and the guide portion 14*d* formed at the bottom cover 14 have been already explained. In the instant embodiment, three guide members 23, 24 and 25, which are all made of synthetic resin, are additionally provided. The guide member 23 includes a shaft portion 23*a* and a hook portion 23*b.* The shaft portion 23 is fit at its opposite ends into cylindrical bearings 1*h* and 2*b* formed at the outer walls 1 and 2, and the hook portion 23*b* is engaged to the shaft 9. The structures of the guide members 24 and 25 are explained with reference to FIG. 2. The guide member 24 is rotatably carried by the shaft 4, and the guide member 25 is rotatably carried at a shaft portion 1*i* standing on the outer wall 1. The shaft portion 24*a* of the guide member 24 is fit into a hole of the guide member 25 to thereby keep the guide members 24 and 25 in a position as illustrated in FIG. 2. The guide member 24 has two guide portions 24*b* and 24*c* for the later mentioned purpose. A bill-shaped distal end 24*d* of the guide member 24 is inserted into the groove 18*b* formed at an outer surface of the transfer drum 18. As mentioned earlier, there are formed two grooves 18*b,* and accordingly there are formed two distal ends 24*d.* However, since they overlap each other, FIG. 2 illustrates them as if they are one unit.

Hereinbelow, a printing mechanism is explained. The printing mechanism includes an ink roller assembly and a printer. The ink roller assembly in the instant embodiment includes an ink arm 26 rotatably carried at a shaft portion 2*c* formed with the outer wall 2, and an ink roller 27 rotatably carried at a shaft portion 26*a* formed at a distal end of the ink arm 26. The ink arm 26 is illustrated in FIGS. 1 and 2 with an alternate long and two short dashes line for the sake of simplification, and the shaft portions 2*c* and 26*a* are indicated with "X" and " ", respectively. The ink arm 26 is actuated for rotation in a clockwise direction by a spring (not illustrated). FIG. 1 illustrates that the ink arm 26 is prevented from rotation by a stopper (not illustrated). The ink roller 27 is comprised of a frame made of synthetic resin and made in the form of a bobbin, and flexible material impregnated with ink, secured to the frame. FIG. 1 illustrates a flange portion 27*a* of the frame formed at opposite ends facing the outer walls 1 and 2, and a roll-shaped material 27*b* impregnated with ink.

Figure 10:
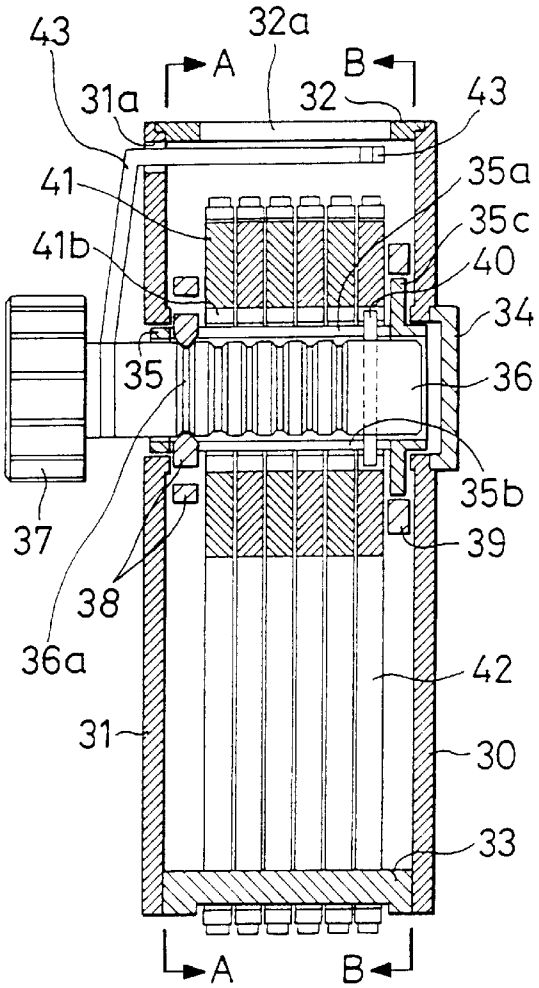
FIG. 10 is a cross-sectional view illustrating an internal structure of a printer illustrated in FIG. 1.

A printer P is disposed between the arms 10*c* and 10*d* of the manual lever 10. The printer P is positioned between the arms by inserting screws 28 and 29 into the elongate holes 10*g* and 10*i* to be screwed with internally threaded portions (not illustrated) formed at the printer P. A structure of the printer P is explained in detail with reference to FIGS. 10, 11 and 12. FIG. 10 is a cross-sectional view of viewing the printer P illustrated in FIG. 1 from the left. A housing of the printer P is comprised of two side plates 30 and 31, a platen 32, and a receiver plate 33. There are provided other members such as a member acting as a beam disposed between the two side plates 30 and 31, however, as they are well known members, they are omitted. The two side plates 30 and 31 are formed with round holes of the same size at facing position. A later mentioned sleeve is supported by the round holes. The round hole of the side plate 30 is covered with a cover 34, however, which has no technical meaning. The side plate 31 is formed with a hole 31*a* for the later mentioned purpose, and the platen 32 is formed with a window 32*a.*

Figure 11:
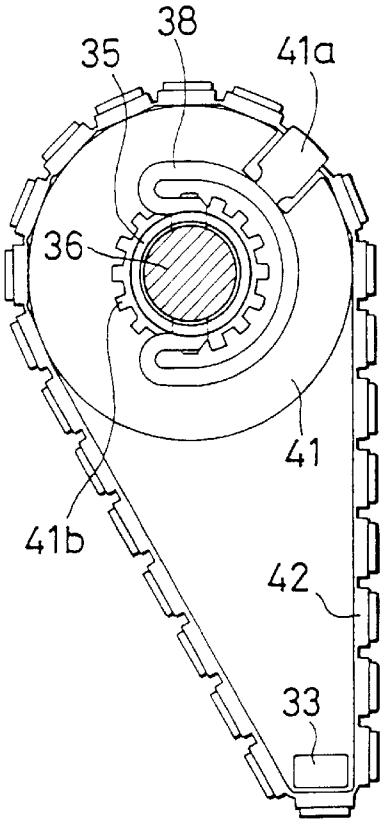
FIG. 11 is a cross-sectional view taken along the line A—A in FIG. 10.

A cylindrical sleeve 35 is rotatably fit into the round holes formed at the side plates 30 and 31 in facing position. A set shaft 36 is connected at one end to a knob 37, and is rotatably fit into the sleeve 35. The set shaft 36 is formed at an outer surface thereof with six, ring-shaped grooves 36*a.* The sleeve 35 is formed thereabove and therebelow with axially extending slits 35*a* and 35*b,* which is continuous at their left ends with holes larger than a width of the slits. A stopper member 38 having resiliency, as illustrated in FIG. 11, is inserted at its distal end into the holes, and fit into a groove 36*a* situated leftmost in FIG. 10. Thus, the stopper member 38 prevents the sleeve 35 from being drawn out, and at the same time, as will be obvious from the later made explanation, makes click action for axial movement of the set shaft 36, cooperating with the groove 36*a* to thereby constitute an a regulation mechanism.

Figure 12:
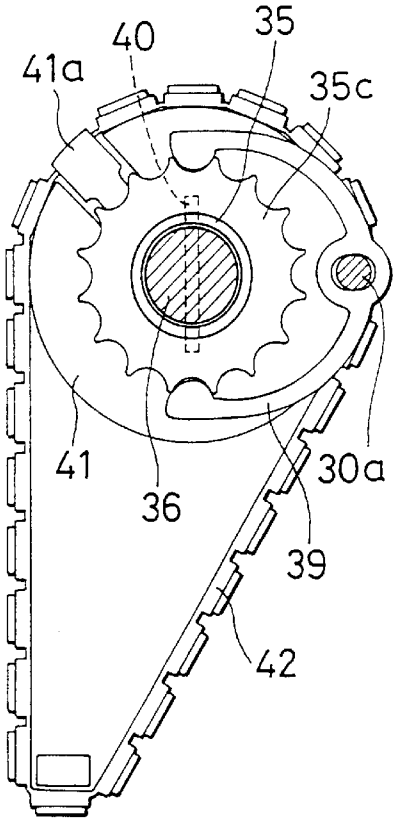
FIG. 12 is a cross-sectional view taken along the line B—B in FIG. 10.

In FIG. 10, the sleeve 35 is formed at a right end thereof with a ring-shaped portion 35*c.* As is understood in view of FIG. 12, the ring-shaped portion 35*c* is formed at a circumferential surface thereof with sixteen recessed portions. To a shaft portion 30*a* standing on the side plate 30 are secured a stopper member 39 forming two arms whose tip ends are made to make compressive contact with a circumferential surface of the ring-shaped portion 35*c.* As will be understood in view of FIGS. 10 and 12, a pin 40 is pressed into the set shaft 36. The pin 40 passes through the slits 35*a* and 35*b* of the sleeve 35. Hence, when the set shaft 36 is rotated by means of the knob 37, the pin 40 and the sleeve 35 are made to rotate together. Thus, the above mentioned ring-shaped portion 35*c* and the stopper member 39 cooperate with each other to constitute the regulation mechanism for controlling rotation position of the set shaft 36.

As is understood in view of FIG. 10, six set wheels 41 are rotatably supported around the sleeve 35. A printing belt 42 is put around each of the set wheels 41. Since each set of the set wheel 41 and the printing belt 42 has the common relation therebetween, only one set is explained with reference to FIG. 11. The set wheel 41 is made of synthetic resin, and is formed at an outer surface with a projection 41*a,* and at inner surface with sixteen grooves 41*b.* The pin 40 is to fit at a tip end thereof into the grooves 41*b.* The number of the grooves 41*b* is the same as the number of the recesses of the ring-shaped portion 35*c.* Because of the above mentioned relation, the grooves 41*b* and the recesses have common angular position.

The printing belt 42 is not ring-shaped, but string-shaped in a unit. The opposite ends of the printing belt are inserted into an L-shaped groove formed at opposite sides of the projection 41*a,* and designed not to be drawn out of the groove in a conventional way. The assembled printing belt 42 is tensioned by the receiver plate 33, in which the printing belt 42 is bent by a certain angle by the receiver plate 33. The friction between the printing belt and the receiver plate prevents the set wheel 41 from readily rotating. The printing belt is formed at a surface thereof with marks such as figures. As is well known, half of the marks are for printing, and the other half are for appendixes. On printing, marks necessary for printing are disposed below the receiver plate 33.

On the other hand, as illustrated in FIG. 10, an indicator 43 is connected to the set shaft 36. The indicator is rotatable relative to the set shaft 36, however, when the set shaft 36 makes axial movement, the indicator also makes movement together with the set shaft. The indicator 43 passes through the hole 31*a* of the side plate 31, and extends between the window 32*a* and the printing belt 42. The indicator 43 is formed at a tip end thereof with an indication point 43.

The printer P has the above mentioned structure. When desired marks for printing are aligned below the receiver plate 33, the followings are carried out. The marks are set by means of the knob 37, and are visually confirmed through the window 32*a*. First, a printing belt 42 in which it is desired to change marks is selected. For selection, the knob 37 is horizontally handled in FIG. 10. In FIG. 10, the pin 40 is fit into the groove 41*b* situated rightmost, of the set wheel 41, and the indication point 43*a* is situated above the printing belt 42 situated rightmost. Accordingly, this condition indicates that marks of the printing belt 42 situated rightmost can be selected.

Then, when the printing belt 42 situated second rightmost is desired to select, the set shaft 36 is horizontally moved, grasping the knob 37. This step is carried out against the resiliency of the stopper member 38, and hence the stopper member 38 is pushed out of the groove 36*a* into which the stopper member 38 has been fit in a position illustrated in FIG. 10, resulting in that the stopper member 38 is fallen into an adjacent groove 36*a*. At this stage, the indication point 43*a* is situated above the printing belt 42 situated second rightmost, and the pin 40 is fit into the groove 41*b* situated second rightmost, of the set wheel 41. Hence, by ceasing the movement of the set shaft 36 to the left at this time, the printing belt 42 situated second rightmost is finally selected. The set shaft 36 is half-fixed with respect to horizontal movement due to fit engagement between the stopper member 38 and the groove 36*a*.

Then, desired marks are selected in the printing belt 42 situated second rightmost. To this end, the set shaft 36 is rotated by means of the knob 37. The rotation of the set shaft 36 also rotates the sleeve 35 due to the fit between the pin 40 and the slits 35*a* and 35*b*, and further rotates the set wheel 41 situated second rightmost due to the fit between the pin 40 and the groove 41*b*. The remaining five set wheels 41 are not made to move because of the reasons mentioned earlier. The indicator 43 is not rotated because it is fit into the hole 31*a* of the side plate 31, resulting in that relative angular position between the indicator and the set shaft is merely changed.

As is well known, when a particular mark for printing is positioned on the receiver plate 33, the same mark for appendix is situated at the indication point 43*a*. Thus, what to do is to stop the rotation of the set shaft 36 when a desired mark for appendix comes to the indication point 43*a*. The set shaft is half-fixed at the position where it stops, by means of the regulation mechanism comprising the ring-shaped portion 35*c* and the stopper member 39. Hence, the selected mark is always made to stop relative to the receiver plate 33 in ideal condition, and the marks in all of the printing belts 42 are all aligned in a line. Thus, it is ensured to have a qualified printing surface.

The explanation about the printing mechanism is now finished, and hereinbelow is explained an indispensable structure for adhering the label 12*b* onto a package. The structure is quite simple. An adhesive roller 44 rotatably carried at the shaft 6 plays a part of adhering the label onto a package. Since the adhesive roller 44 has a well known shape, the shape of the adhesive roller is not detailed. The adhesive roller 44 has non-uniform cross-section, and is designed to have a smallest surface at which the adhesive roller makes contact with the label 12*b*, but uniformly have a relatively great constant pressure. In the drawings, the adhesive roller 44 seems to interfere with the above mentioned engagement member 15 in operation, however, they are arranged so that they do not interfere with each other, and can work independently.

Figure 9A:
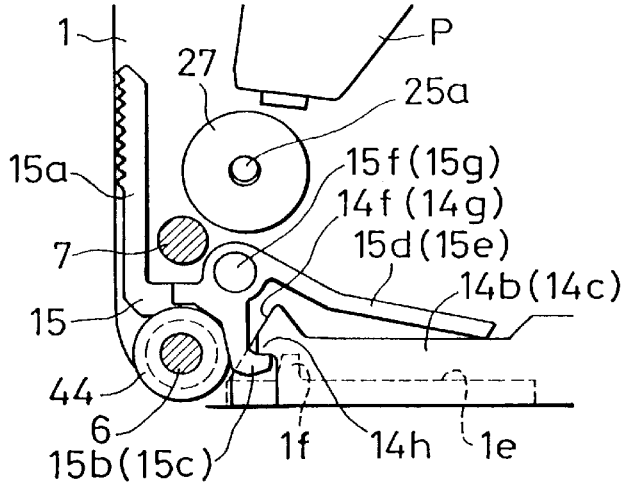
FIG. 9A is a partially enlarged view of FIG. 1.
Figure 9B:
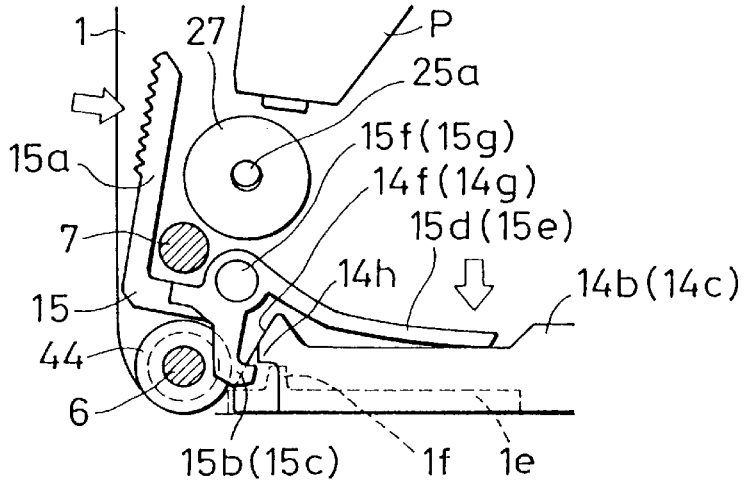
FIG. 9B is an enlarged view, similar to FIG. 9A, showing the moment when a bottom cover is released.
Figure 9C:
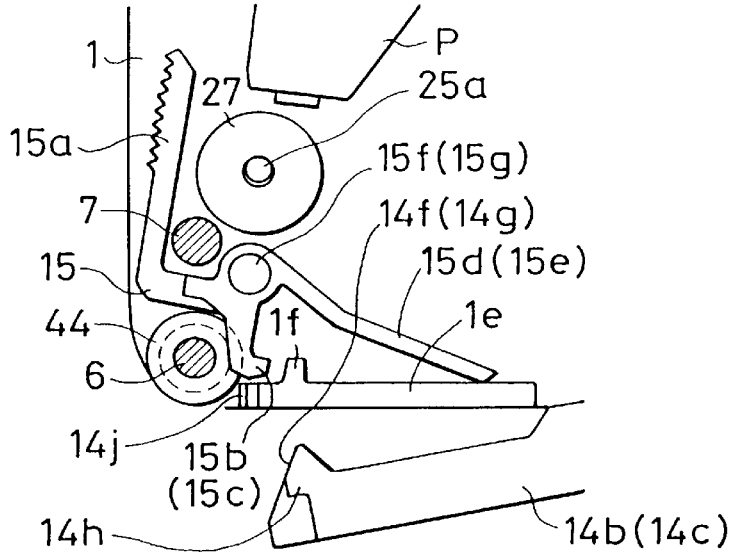
FIG. 9C is an enlarged view, similar to FIG. 9A, showing a condition just after a bottom cover has been released.

Hereinbelow is explained a step of setting the label tape 12 and a step of printing and attaching. In order to set the label tape 12 for use, the bottom cover 14 has to be made open. With reference to FIGS. 9A to 9C, how the bottom cover is made open is explained. FIG. 9A illustrates the bottom cover 14 being closed. In this condition, the sidewall 14*b* of the bottom cover 14 deforms the resilient portion 15*d* of the engagement member 15. In other words, the bottom cover 14 is pushed by the resilient portion 15*d* in such a direction as the bottom cover 14 is open. However, since a hook portion 15*b* of the engagement member 15 is engaged to an engagement portion 14*h* of the sidewall 14*b*, the bottom cover is kept closed. In this condition, a sidewall 14*c* of the bottom cover 14 deforms a resilient portion 15*e* of the engagement member 15, thereby an engagement portion (not illustrated) being engaged to a hook portion 15*c* of the engagement member 15.

When the finger-placed portion 15*a* of the engagement member 15 is pushed, the engagement member 15 is made to rotate in a clockwise direction. Thus, a force with which the bottom cover 14 is biased by the resilient portions 15*d* and 15*e* becomes greater and greater. Then, when the bottom cover 14 is disengaged from the hook portions 15*b* and 15*c*, the bottom cover 14 is forcibly pushed out, and rotates about the shaft 5 in a counterclockwise direction. FIG. 9B illustrates the moment when the bottom cover has just been disengaged from the hook portions, and FIG. 9C illustrates the condition immediately after the bottom cover 14 has started rotating. Since the bottom cover is disengaged from the hook portions in the above mentioned way, even if the handy labeler is held in any position, for instance even if the bottom cover 14 is held facing upwardly, the bottom cover is not only disengaged from the hook portions, but also is surely pushed out. FIG. 8 illustrates the bottom cover 14 has been open in the above mentioned way.

Then, a roll of the label tape 12 is set. In FIG. 8, a roll of the label tape 12 is already set to the tape support member 13. The step of setting the label tape to the tape support member has already been explained, and thus, is not explained here. In the condition illustrated in FIG. 8, there are two ways for inserting the label tape 12 with a tip end thereof facing downwardly. In the instant embodiment, since the label 12*b* is temporarily adhered onto the mount sheet 12*a*, a tip end of the label tape 12 may be hung down straightly, as illustrated. However, when the label 12*b* is temporarily adhered onto a lower surface of the mount sheet 12*a*, a tip end of the label is hung down along both the guide portion 13*a* of the tape support member 13 and the guide portion 24*c* of the guide member 24 in FIG. 2 with the label tape 12 being reversed with respect to its side relative to the tape support member 13.

After the condition illustrated in FIG. 8 has been set, the bottom cover 14 is closed. If the bottom cover 14 is further rotated in a clockwise direction from the position illustrated in FIG. 9C, the sidewalls 14*b* and 14*c* of the bottom cover 14 attempts to push the resilient portions 15*d* and 15*e* of the engagement member 15 to thereby push the engagement member 15 in a counterclockwise direction. On the other hand, the inclined surface portions 14*f* and 14*g* push the hook portions 15*b* and 15*c* at the rear to thereby enhance the resilient force of the resilient portions 15*d* and 15*e* because of cam action, that is, provide the engagement member 15 with a force directed in a clockwise direction. After the resilient portions 15*d* and 15*e* has been sufficiently deformed in the above mentioned way, when the two engagement portions 14*h* (the other engagement portion is not illustrated) get over the hook portions 15*b* and 15*c,* the hook portions 15*b* and 15*c* move to the rear of the engagement portions. As a result, the bottom cover is closed, as illustrated in FIG. 9A.

Hereinbelow is explained the operation of the label tape 12 with reference to FIG. 2. In FIG. 2, suppose that the handy label is already in usable condition, but a tip end of the label tape 12 is hung down from a left end of the receiver plate 14. First, a portion hung down of the label tape 12 is removed. Then, a tip end of the mount sheet 12*a* is inserted between the transfer drum 18 and the guide portion 14*d,* and at least one of the holes of the mount sheet 12*a* is engaged to the pin 18*a*. Each time the manual lever 10 is gripped, the transfer drum 18 is rotated in a counterclockwise direction with the result that a tip end of the mount sheet 12*a* is wound. The rotation of the transfer drum 18 is made in the same way as the rotation when used, and will be explained in detail.

As the tip end of the mount sheet 12*a* is advanced between the transfer drum 18 and the guide member 25, a distal end 24*d* of the guide member 24 disengages the mount sheet from the pin 18*a*. Thereafter, the mount sheet is advanced between the guide portion 24*b* of the guide member 24 and the guide member 25, and further along a cutter portion 16*b* of the transfer member 16, thereby appearing outside through the bottom. Thus, there is no looseness in the mount sheet below the receiver plate 14 with the holes of the label tape 12 being fit with the hook 20*a* of the label stopper 20. FIG. 2 illustrates such a condition. If a tip end of the mount sheet 12*a* is seized with a hand, and the mount sheet is moved to the left with being twisted, the mount sheet 12*a* is cut by means of the cutter portion 16*b*.

The steps of printing and adhering in the instant embodiment are explained hereinbelow with reference mainly to FIGS. 1 and 4A to 7B. FIGS. 4A, 5A, 6A and 7A are views viewed from the same direction as FIG. 1, and FIGS. 4B, 5B, 6B and 7B are views viewed from the rear of FIG. 1. FIGS. 1, 4A and 4B illustrate stationary condition. In the illustrated stationary condition, a main body (the outer walls 1 and 2) and the manual lever 10 are seized, and are gripped against the compression spring 11. As a result, the manual lever 10 is rotated in a counterclockwise direction in FIG. 4B. Then, the transfer member 16 comes to be in mesh with the tooth portion 10*h* formed at the arm 10*d* of the manual lever 10, and begins rotating about the shaft 5 in a counterclockwise direction. The rotation of the arm 10*d* in a clockwise direction causes the slide member 12 to slide to the left, resulting in that the engagement member 21 retracting from the stopper pawl 20*b*.

The commencement of the rotation of the transfer member 16 in a counterclockwise direction in FIG. 4B means the rotation in a clockwise direction in FIG. 4A. When the transfer member 16 commences to rotate in a clockwise direction in FIG. 4A, the ratchet pawl 17 moves to the right, namely, the pawl portion 17*b* makes slide movement on the longer tooth surface of the tooth formed at the ratchet wheel 19. At the same time, the arm 10*c* rotates in a counterclockwise direction, resulting in that the pushing portion 10*f* pushes down a tip end of the resilient portion 17*a* of the ratchet pawl 17. Thus, the resilient portion 17*a* is deformed, and the resulting resilient force acts as a resistive force against the rotation of the arm 10*c*. In addition, the resistive force becomes greater and greater.

Figure 5A:
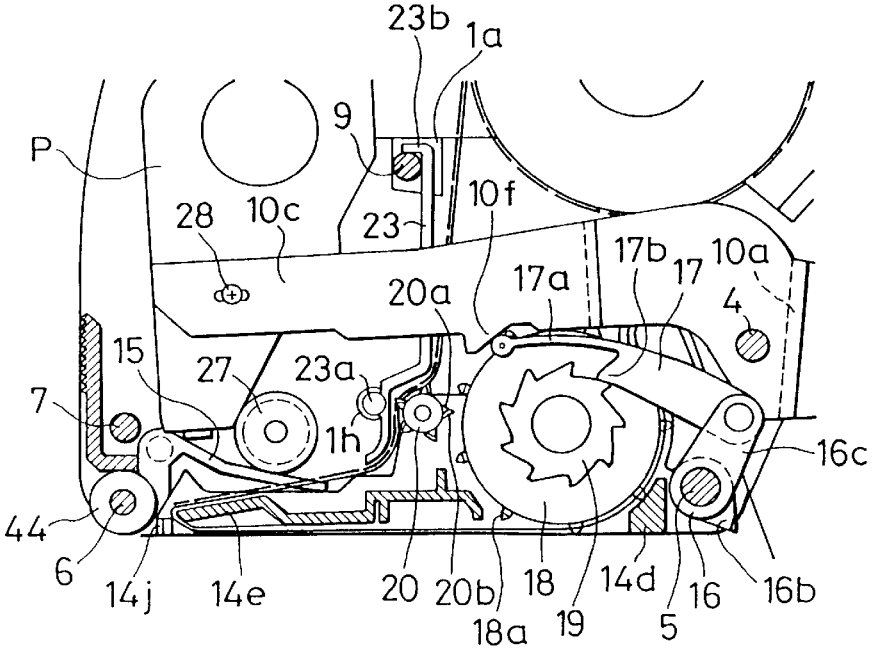
FIG. 5A is a side view, similar to FIG. 4A, showing a manual lever-gripping step.
Figure 5B:
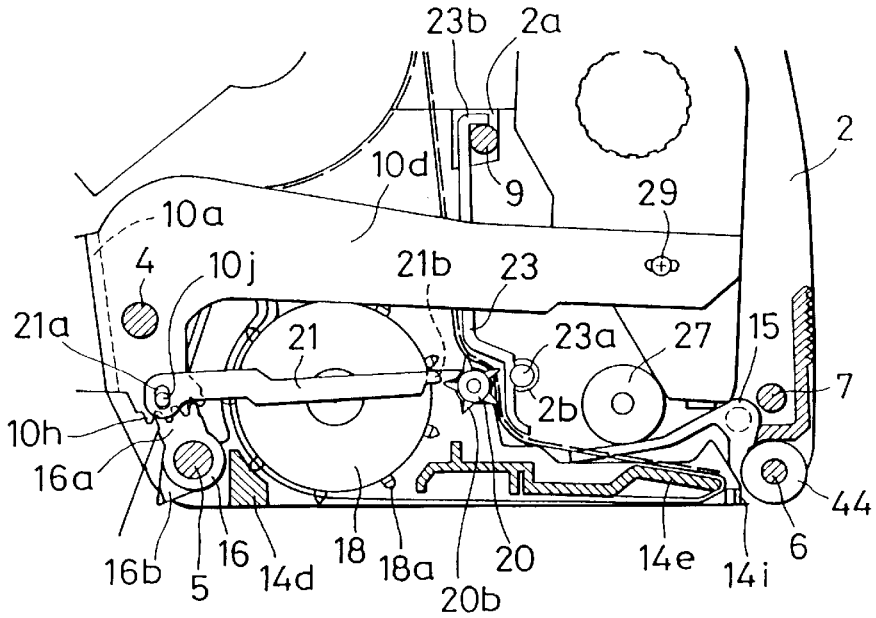
FIG. 5B is a rear view of FIG. 5A with an outer wall being removed.

In the step of gripping, the printer P descends as the arms 10*c* and 10*d* rotate. Then, a print surface of each of the printing belts 42 first makes contact with the ink-impregnated material 27*b* of the ink roller 27. Immediately after that, the side plates 30 and 31 of the printer P make contact at their ends situated closer to the receiver plate 33 and then the side plates themselves with the flange portion 27*a* of the ink roller 27 to thereby push the ink roller 27. Hence, the ink arm 26 (see FIG. 1) supporting the ink roller 27 therewith commences to rotate in a counterclockwise direction against the spring (not illustrated). Thus, the ink roller 27 rolls on the above mentioned print surface, ensuring adhesion of ink thereto, and escapes from a locus of the print surface. FIGS. 5A and 5B illustrate such a condition.

Figure 6A:
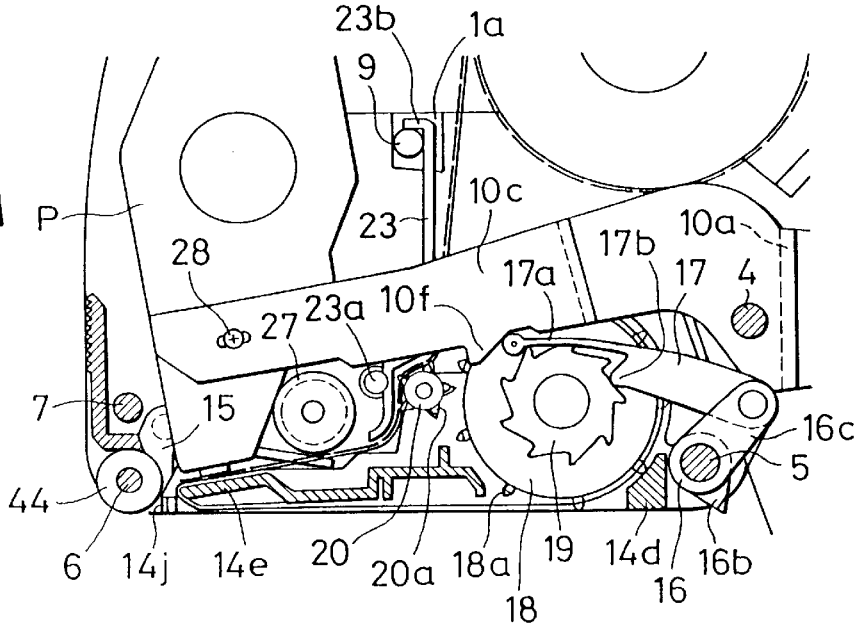
FIG. 6A is a side view, similar to FIG. 5A, showing a final position in a manual lever-gripping step.
Figure 6B:
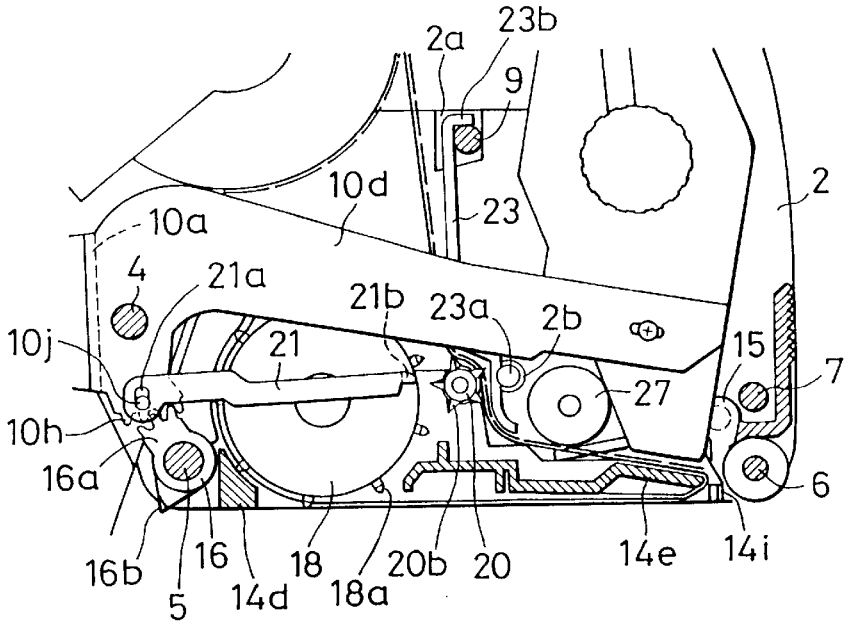
FIG. 6B is a rear view of FIG. 6A with an outer wall being removed.

As the gripping step further proceeds from the condition illustrated in FIGS. 5A and 5B, the pawl portion 17*b* of the ratchet pawl 17 climbs over a distal end of a tooth. Then, the pawl portion 17*b* abruptly drops onto a longer tooth surface of an adjacent tooth due to a strong resilient force of the resilient portion 17*a*. The drop significantly reduces the resistive force against the arm 10*c* or the manual lever 10, which facilitates the manual lever 10 to be further gripped. As a result, the drop speed of the printer P is instantaneously increased, and hence the printer P makes impact abutment with the label 12*b* mounted on the receiver plate 14*e,* and accomplish printing. Thus, even if the gripping of the manual lever is slowly carried out, it is possible to print with a suitable printing concentration. FIGS. 6A and 6B illustrate the situation.

Figure 7A:
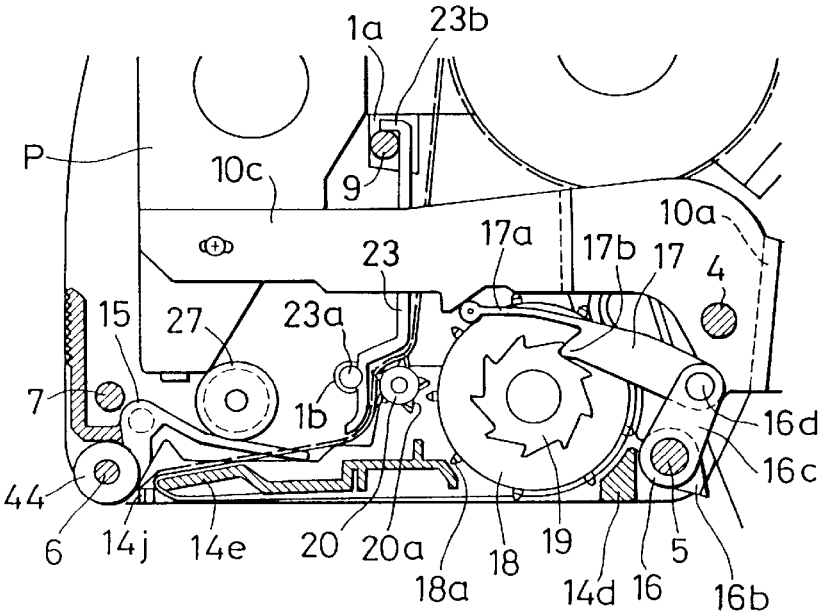
FIG. 7A is a side view, similar to FIG. 4A, showing a manual lever-releasing step.

After the printing has been carried out in the above mentioned way, the manual lever is released from being gripped, then the manual lever enters the releasing step. In the step, the arm 10*d* commences to rotate in a counterclockwise direction in FIG. 6B, and accordingly, the printer P commences to ascend, the transfer member 16 commences to rotate in a clockwise direction, and the slide member 21 commences to move to the right. As the rotation of the transfer member 16 means the rotation in a counterclockwise direction in FIG. 6A, the ratchet pawl 17 commences to move to the left in FIG. 6A. At that time, since the arm 10*c* has commenced to rotate in a clockwise direction, a tip end of the resilient portion 17*a* can make slide movement on the pushing portion 10*f* without receiving much resistance. The pawl portion 17*b* of the ratchet pawl 17 makes contact with a shorter tooth surface of the ratchet wheel 19 whose distal end the ratchet pawl 17 climbed over in the gripping step. The FIGS. 7A and 7B illustrate the condition where the ratchet pawl pushes the shorter tooth surface.

Figure 7B:
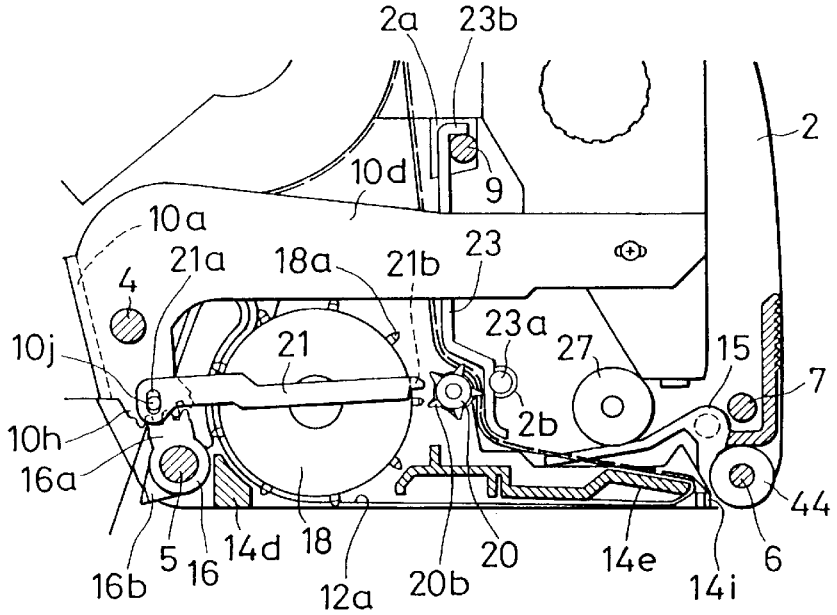
FIG. 7B is a rear view of FIG. 7A with an outer wall being removed.

Thus, in FIG. 7B, the transfer drum 18 is in the process of rotation in a clockwise direction. Due to the fact that the mount sheet 12*a* is drawn by the transfer drum 18, the label stopper 20 is also made to rotate in a clockwise direction, and the engagement member 21*b* of the slide member 21 is just going to enter a locus of the stopper pawl 20*b*. In addition, since the label tape 12 is fed and the mount sheet

12*a* is abruptly diverted by a tip end of the receiver plate 14*e,* the label 12*b* temporarily adhered onto the mount sheet and already have been printed is peeled off the mount sheet 12*a* due to rigidity of itself, and is going to advance above the guide portions 14*i* and 14*j* towards beneath the adhesive roller 44.

FIG. 4B illustrates the stationary condition where the transfer drum 18 is made to rotate additionally relative to the above mentioned condition, and all operation is ceased. At this time, the label stopper 20 cannot rotate, because the stopper pawl 20*b* is engaged to the engagement portion 21*b* of the slide member 21. On the other hand, since the transfer drum 18 is not able to rotate in a reverse direction, the mount sheet 12*a* is able to keep a tension between the label stopper 20 and the transfer drum 18 without being loosened. Thus, the mount sheet 12*a* does not make random movement when the label 12 is applied to an article or a package thereof, and it is possible to accomplish printing marks on the label 12*b* at the exact position without illegibleness.

Since FIGS. 4A and 4B illustrate a condition before the handy labeler is used, there is not illustrated the label 12*b* having been printed, and further fed to beneath the adhesive roller 44. At this time, the label 12*b* further fed from the condition illustrated in FIG. 7 is almost peeled off the mount sheet 12*a,* however, a rear end of the label still makes contact with the mount sheet 12*a*. The parts of the label peeled off the mount sheet mount on the guide portions 14*i* and 14*j*. This condition is illustrated in FIG. 2. Accordingly, when the printed label 12*b* is adhered to a package and so on, the label is made to move downwardly and press onto a package in FIG. 2, and the handy labeler in its entirety is pulled to the right. Then, the adhesive roller 44 rolls on the print surface of the label 12*b,* ensuring that the label tape is adhered to a package.

The transfer drum 18 and the ratchet wheel 19 is integrally made of synthetic resin in the instant embodiment, however, they may be separately fabricated and connected together. As an alternative, they may be connected to each other through an appropriate connecting member.

INDUSTRIAL APPLICABILITY

As mentioned above, the handy labeler in accordance with the present invention is capable of clearly printing marks on a label with a certain printing concentration, even if whoever may handle the labeler. In addition, as the handy labeler is light in weight, rigid and user-friendly, it is suitable for use in a retail shop as well as a shop selling a mass of products.

What is claimed is:

1. A handy labeler including a label tape comprising a long mount sheet and a plurality of labels temporarily adhered onto said mount sheet, a printer being made to make contact with said labels from a stationary position and print on said labels in a manual lever gripping step, said printer being made to return to said stationary position and a transfer drum being made to rotate to thereby feed said label tape by one label distance in a manual lever releasing step, a printed label being peeled off said mount sheet and partially fed outside a main body, said handy labeler being characterized by: a ratchet pawl having a pawl portion and a resilient portion deformable by being compressed by said manual lever, said ratchet pawl making forward movement in a manual lever gripping step and making backward movement in a manual lever releasing step; and a ratchet wheel having a plurality of ratchet teeth including longer tooth surfaces and shorter tooth surfaces, said pawl portion making slide movement on said longer tooth surfaces towards a distal end of the tooth, when said ratchet pawl makes forward movement, said ratchet wheel being rotated by said shorter tooth surfaces being compressed by said pawl portion to thereby rotate said transfer drum, when said ratchet pawl makes backward movement, said resilient portion being deformed by said manual lever when said pawl portion is making slide movement on said longer tooth surfaces while said ratchet pawl makes forward movement, and resulting resilient force acting on said manual lever as a resistive force, said resistive force being abruptly decreased at the moment when said pawl portion exceeds said distal end of tooth to thereby cause said manual lever to make said printer make impact contact with said label.

* * * * *